US005590442A

United States Patent [19]

Hirschek et al.

[11] Patent Number: 5,590,442

[45] Date of Patent: Jan. 7, 1997

[54] DEVICE FOR PRODUCING A NONWOVEN FABRIC MADE OF FIBER MATERIAL

[75] Inventors: Herwig Hirschek, Bobingen; Manfred Schäffler, Merching, both of Germany

[73] Assignee: Autefa Maschinenfabrik GmbH Augsburg, Friedberg, Germany

[21] Appl. No.: 397,080

[22] PCT Filed: Sep. 8, 1993

[86] PCT No.: PCT/EP93/02430

§ 371 Date: Feb. 27, 1995

§ 102(e) Date: Feb. 27, 1995

[87] PCT Pub. No.: WO94/05836

PCT Pub. Date: Mar. 17, 1994

[30] Foreign Application Priority Data

Sep. 10, 1992 [DE] Germany ..... 9212215 U

[51] Int. Cl.[6] ..... D01G 25/00

[52] U.S. Cl. ..... 19/163; 226/119; 242/417.3; 270/30.03

[58] Field of Search ..... 19/161.1, 163, 19/240, 300; 270/30, 39; 226/119, 44; 242/417.3

[56] References Cited

U.S. PATENT DOCUMENTS

| | | | |
|---|---|---|---|
| 3,038,681 | 6/1962 | Herr | 242/417.3 X |
| 3,414,208 | 12/1968 | Butler, Jr. et al. | 226/119 X |
| 3,703,023 | 11/1972 | Kraus et al. | 19/240 |
| 4,427,404 | 1/1984 | Yamada | 19/163 X |
| 4,747,188 | 5/1988 | Cooper et al. | 19/300 |
| 5,149,075 | 9/1992 | Crowley et al. | 270/39 |

FOREIGN PATENT DOCUMENTS

| | | |
|---|---|---|
| 1927863 | 11/1973 | Germany . |
| 2429106C2 | 9/1983 | Germany . |

*Primary Examiner*—John J. Calvert
*Attorney, Agent, or Firm*—McGlew and Tuttle

[57] ABSTRACT

A device for producing nonwoven fabric with a carding machine 3 and a nonwoven fabric layering apparatus 2. A web storage device 5 with a variable storage volume is arranged between the web producer 3 and the nonwoven fabric layering apparatus 2. The web storage device 5 is controlled by the layering belts 8, 9 of the non-woven fabric layering apparatus 2. The rotational speed VB of the layering belts 8, 9 is variable and fluctuates in rhythm with the absolute traveling speed VL of the layering carriage in the inlet area 10. The web storage device 5 is emptied and filled at the same rhythm as the web 4 by control coupling.

21 Claims, 7 Drawing Sheets

DEVICE FOR PRODUCING A NONWOVEN FABRIC MADE OF FIBER MATERIAL

FIELD OF THE INVENTION

The present invention pertains to a device for producing a nonwoven fabric made of fiber material with a web producer and a nonwoven fabric layering apparatus, which has an upper carriage and a layering carriage.

BACKGROUND OF THE INVENTION

Such a device for producing nonwoven fabric is known from German Auslegeschrift No. DE-AS 19 27 863. In the prior-art nonwoven fabric layering apparatus, there is a problem with web layering in the edge area of the layering width. The lower layering carriage must slow down its travel at these sites, come to a standstill, and then accelerate again in the opposite direction. The web coming from the web producer is, of course, fed to the nonwoven fabric layering apparatus at a constant speed. In the nonwoven fabric layering apparatus, the layering belts run at a constant speed, which causes the web to leave the nonwoven fabric layering apparatus at always the same speed. However, in the edge areas, where the lower layering carriage has a lower speed due to the slowing down, stopping and then accelerating, more web is layered in the outside edges than in other areas of the layering width due to this difference in speed.

A further development of the nonwoven fabric layering apparatus is known from German Patent No. DE-PS 24 29 106. It claims to prevent the edge buildups by having travel movements of the upper carriage and layering carriage being uncoupled from one another and being separately adjustable. Auxiliary carriages are then provided as well in order to compensate for the resulting differences in length of the layering belts. The traveling speeds of the upper carriage, the layering carriage and the auxiliary carriages must then support one another in a certain ratio. This requires a considerable expense for construction and control. Besides, the complicated kinematics impedes the adjusting of different operating conditions of the nonwoven fabric layering apparatus for adaptation to different types of webs or web producers.

BACKGROUND OF THE INVENTION

The task of the present invention is to design a device for producing a nonwoven fabric, and in particular to a device that makes it possible to influence the web layering and the nonwoven fabric formation in a simple and easily controllable manner.

In the present invention there is a web producing means which generates a nonwoven web from a fibrous material. The web producing means produces this nonwoven fiber at a substantially constant rate. A layering apparatus or means receives the web and lays the web down, usually in an alternating pattern. The layering means usually has a set of layering belts for receiving the web, and a layering carriage for discharging the web in the alternating or reciprocating pattern. Because of the movements of the layering carriage, a take-up carriage is provided to compensate for the changing length in the layering belts. A web storage means is positioned between the web producing means and the layering means. When the web producing means produces the web faster than the layering means discharges the web, the web storage means can absorb the excess portions of the web. Likewise when the layering means discharges the web at a higher rate than the web producing means, the web storage means can release additional portions of the web stored in the web storage means.

According to the present invention, a web storage means that has a variable storage volume is arranged between the web producer and the nonwoven fabric layering apparatus. With a corresponding storage control, the web layering and the nonwoven fabric formation can hereby be specifically influenced. Edge buildups of the nonwoven fabric can especially be prevented in a simple manner and without auxiliary carriages or similar design interventions in the nonwoven fabric layering apparatus. However, with the web storage means, the web layering can also be influenced at other sites of the layering width, as specifically more or less web is layered at certain sites, and thus, the thickness of the nonwoven fabric is changed selectively. This so-called "profiling" makes it possible to compensate for thickness errors made by a downstream processing machine, e.g., a needle loom.

There are various possibilities for controlling the web storage means. The web storage means can, e.g., be controlled independently and can achieve the compensation in edge thickness by means of the formation of negative slack in the web with the fabric layering apparatus other-wise running constantly.

In the preferred embodiment, the web storage means is controlled by the layering belts of the nonwoven fabric layering apparatus. In this case, it is recommended to change the rotational or belt speed VB of the layering belts at an inlet to the layering belts and to adapt the speed VB to the desired layering condition in each case rather than leaving it constant any longer. For edge compensation, it is important to allow the rotational speed VB at the inlet in this case to fluctuate in rhythm with the absolute traveling speed VL of the layering carriage. At the reversal areas of the layering carriage with the phases of slowing down, stopping and then accelerating, the rotational speed VB of the layering belts at the inlet is thereby also reduced, with the result that only little or no web comes out at these sites. In this manner, the edge thicknesses are arbitrarily influenced and especially prevented.

Additionally or alternatively, a specific difference in speed between the rotational speed of the layering belts at the inlet and the traveling speed of the layering carriage can be generated. Thereby, the web runs out selectively more quickly or more slowly and produces a corresponding changed nonwoven fabric thickness. By means of the web storage means, the web can be prevented from being stretched or compressed by this difference in speed in the nonwoven fabric layering apparatus.

There are various possibilities for the design of the web storage means. In the simplest form, it consists of a trough, which takes up the web with more or less slack. Thus, the extent of the web slack determines the storage volume. A movable web storage means, which has a belt loop with variable size, is recommended for a delicate web and for large feed and layering speeds of the nonwoven fabric layering apparatus. More or less web is taken up in the belt loop depending on the size.

The thickness of the web discharged from the layering means can be controlled by a ratio between the speed of the layering carriage and the speed at which the layering means receives the web. The thickness of the web can also be controlled by the web storage means storing excess portions of the web, or delivering additional portions of the web.

If the web storage means is controlled via the layering belt drive of the nonwoven fabric layering apparatus, it is recommended to arrange this drive on a belt deflection means of the nonwoven fabric layering apparatus mounted on the frame. The speed of the layering belt at the inlet of the nonwoven fabric layering apparatus is thereby controlled in an especially simple manner.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
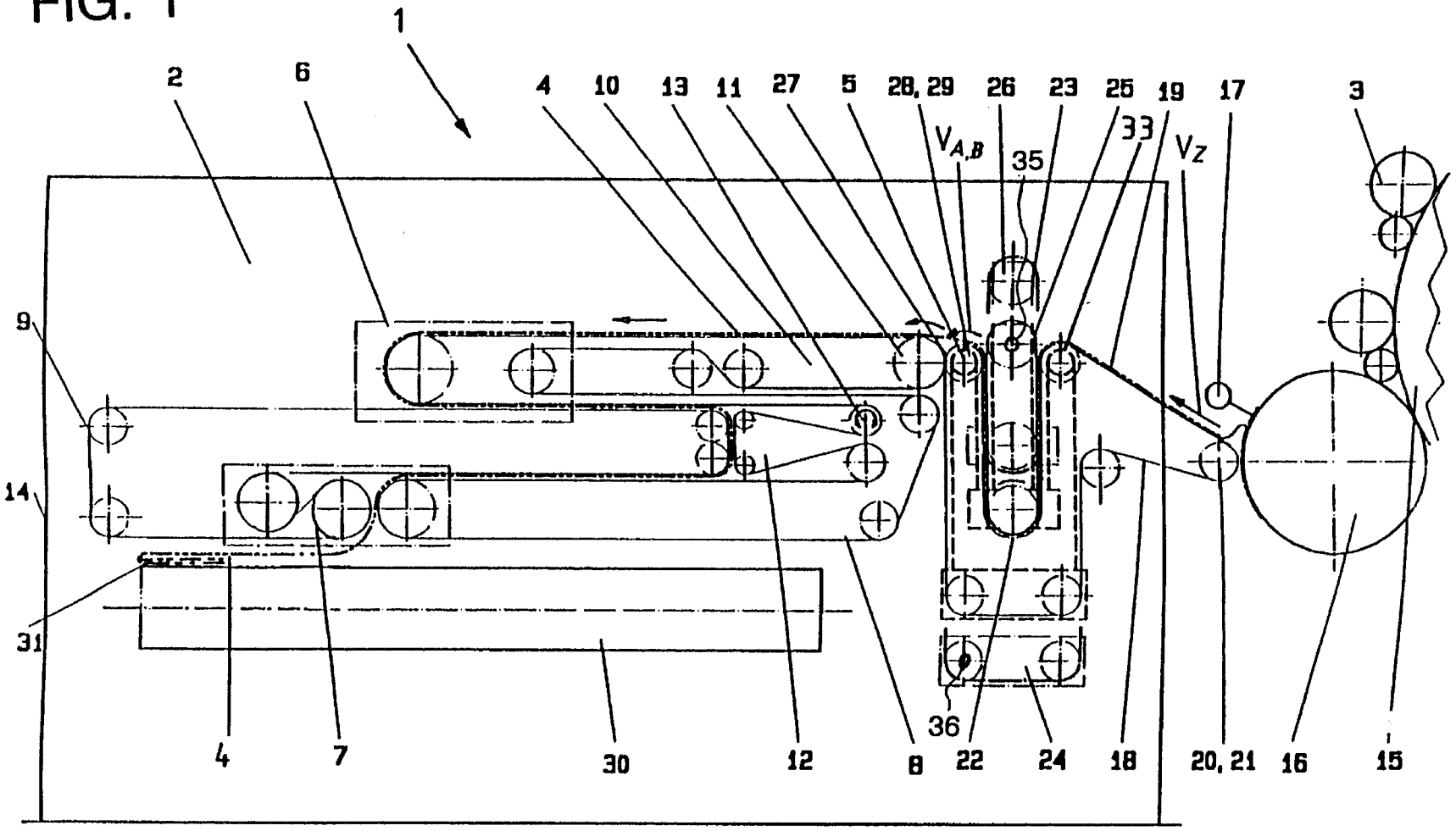
FIG. 1 shows a schematic lateral view of a device for producing a nonwoven fabric with a non-woven fabric layering apparatus, a web storage means and a web producer.

FIG. 31 shows a schematic lateral view of a device for producing a nonwoven fabric 1, which consists of a nonwoven fabric layering apparatus or means 2, a web producer means 3, here represented as a carding machine, and a web storage means 5 arranged between the fabric layering apparatus 2 and the web producer 3. In the carding machine 3, a web 4 consisting of textile fibers is formed. This web 4 is guided to the nonwoven fabric layering apparatus 2 via the web storage means 5. From the layering apparatus 2, the web is layered in a reciprocating pattern on a discharging belt 30 which runs diagonally. In this case, the web 4 is layered and placed onto the discharging belt 30 in several layers one on top of each other. The multilayer web on the discharge belt 30 represents the so-called nonwoven fabric 31, which is then led to a further process, e.g., to a needle loom.

The carding machine 3 consists of a rotating drum 15 and a doffing cylinder 16, which rotates in the opposite direction and strips the web 4 from the drum 15. From the doffing cylinder 16, the web 4 is removed via a doffing comb 17 and forwarded to the web storage means 5. Instead of comb-type doffing combs 17, pull-off rollers or another suitable removal device may also be present.

The nonwoven fabric layering apparatus 2 has two continuous layering belts 8, 9 that are guided in several loops. These layering belts 8, 9 receive the web 4 at the inlet 10 and hold and guide the web between them at least lengthwise. The two layering belts 8, 9 are guided via an upper or take-up carriage 6 and a lower layering carriage 7 and run over rotatable rollers in this case. The layering belts 8, 9 run parallel at least in the loop area between the upper carriage 6 and the layering carriage 7, and they move the web 4 between them. In the embodiment shown, the upper carriage 6 and the layering carriage 7 move in opposite directions and are coupled with one another directly or indirectly in terms of drive or with regards to being driven. In the embodiment shown, the upper carriage 6 moves with half the traveling speed of the layering carriage 7.

As an alternative, the nonwoven fabric layering apparatus may also have carriages moved in the same direction and, e.g., have a design similar to that in DE-AS 19 27 863 not shown.

The layering carriage 7 travels back and forth above the discharging belt 30 and lets the web 4 come out downwards. The speed profiles of the layering carriage 7 are shown in the graphs in FIGS. 4B, 5B, and 6B. The layering carriage 7 moves over the largest area of the layering width of discharge belt 30 with a preferably constant traveling speed VL. At the ends of its path, the so-called reversal points, the carriage 7 must slow down, come to a standstill, change its direction of travel, and then accelerate again. The speed VL has a preferably ramp-like course in these so-called edge phases.

The nonwoven fabric layering apparatus 2 has a frame 14. In this frame are located rotatable rolls or rollers, over which the layering belts 8, 9 are guided and turned around in the manner shown. In the exemplary embodiment shown, only the one layering belt 8, receives the guided web 4 and forwards it to the upper carriage 6. The layering belt 8 is located at the inlet 10. As an alternative, the second layering belt 9 may also be drawn up above the upper carriage 6 from the position shown in FIG. 1 and placed at the inlet 10.

The layering belts 8, 9 have a layering belt drive 13, which drives them at a layering belt speed VBA which is the same for both belts 8, 9. The layering belt speed VBA at the belt drive 13 and the travel movements of the carriages 6, 7 are superimposed during operation. As a result, the layering belts 8, 9 move at a rotational or belt speed VB at the inlet 10. Various courses of the speed VB are shown in the graphs 4A, 5A, and 6A.

In the embodiment shown of the nonwoven fabric layering apparatus 2, a stationary belt deflection means 12 is arranged between the two carriages 6, 7 in the right half of the frame 14. At this belt deflection means 12, the layering belt 8, which leads to the inlet, is guided and fixed in an omega pattern above two smaller and two larger rolls or rollers. The layering belt drive 13 for the layering belt 8 is located on the upper roller of the two larger rollers. In the graphs, FIGS. 4C, 5C, and 6C illustrate the drive movements and the drive speeds VBA of this layering belt drive 13.

In the drive arrangement shown, it is possible for the layering belt drive 13 to travel even essentially straight-sided ramps at the speed VBA. In the collections of graphs 4, 5, and 6, the belt rotational speed VB at the inlet 10 turns out to be the geometric sum of the speeds VBA and VL, i.e., the sum of the speeds of the layering belt drive 13 and the layering carriage 7. A control means 34 controls the drive 13 based on the position and speed of the layering carriage 7 to create the desired speed VB. The control means 34 is preferably computer controlled, but could be any device that performs the described functions. In this case, the layering carriage speed VL enters with its sign dependent on the direction of travel.

Figure 4A:
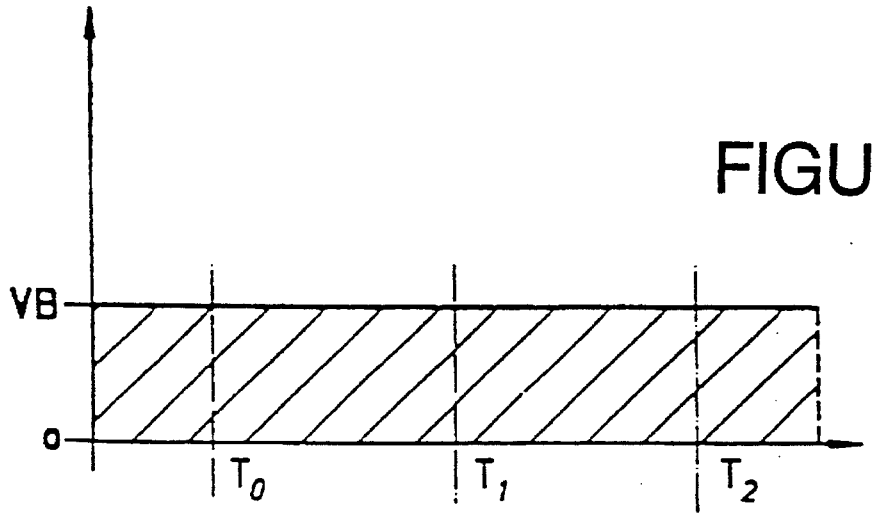
FIGS. 4 to 6 show several speed graphs for the nonwoven fabric layering apparatus.
Figure 4B:
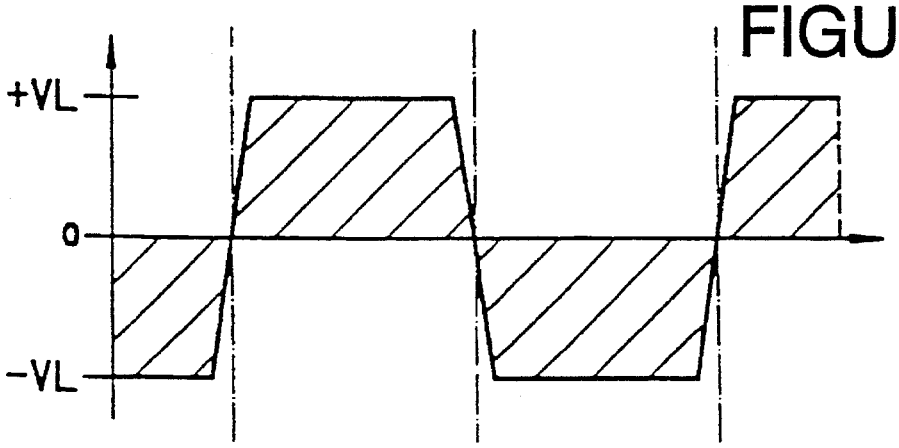
Figure 4C:
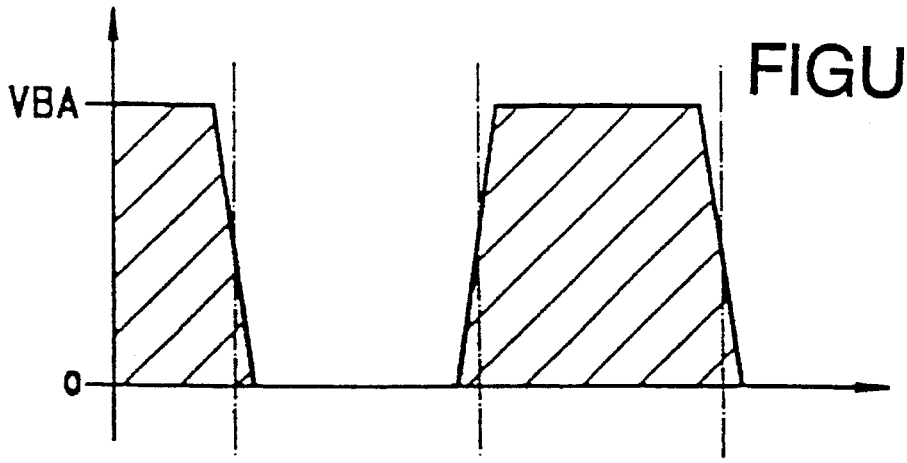

A prior-art nonwoven fabric layering apparatus 2 according to the state of the art, e.g., DE-AS 19 27 863, is shown in the collection of graphs in FIGS. 4A–4C. In this apparatus, the layering belt 8 moves at the inlet 10 at a constant rotational or belt speed VB. For this purpose, the layering belt drive 13 travels the speed profile of VBA shown in FIG. 4C. The ramps of VBA and the layering carriage speed VL compensate for a constant VB at the time of the reversal points designated as T0, T1 and T2. At this speed ratio, the web 4 is constantly fed to the nonwoven fabric layering apparatus 2, and the web 4 is just as constantly layered into nonwoven fabric 31 by the layering carriage 7 onto the discharging belt 30. The rotational speed VB of the layering belts 8, 9 at the inlet 10 is, in this case, also essentially identical to the layering carriage speed VL in the standard area of travel outside of the phases of slowing down and accelerating. In the area of the reversing of the layering carriage 7, the initially mentioned layering problems for the web 4, such as the edge buildups in the nonwoven fabric 31, occur due to the reduced layering carriage speed VL there.

According to the design of nonwoven fabric layering apparatus, the edge buildups can be technically uncritical or insignificant up to a certain level of the layering carriage speed VL, e.g., 55 m/min, and can be cut off on the finished nonwoven fabric 31. The edge buildups are also controlled by the lower ends of the layering belts 8, 9, which are spread out over the discharging belt 30. The lower ends of the layering belts 8, 9 form a closed curtain above the nonwoven fabric 31 and prevent the formation of air vortices. According to the embodiment of the nonwoven fabric layering apparatus 2, the lower ends may also lie with a slight pressure on the nonwoven fabric 31 and hold it securely.

At higher layering carriage speeds VL, difficulties with the web layering may occur. With the upstream web storage means 5, these problems are, however, specifically handled. Various embodiments of the web storage means 5 are shown in the exemplary embodiments of FIGS. 1 through 3.

Figure 2:
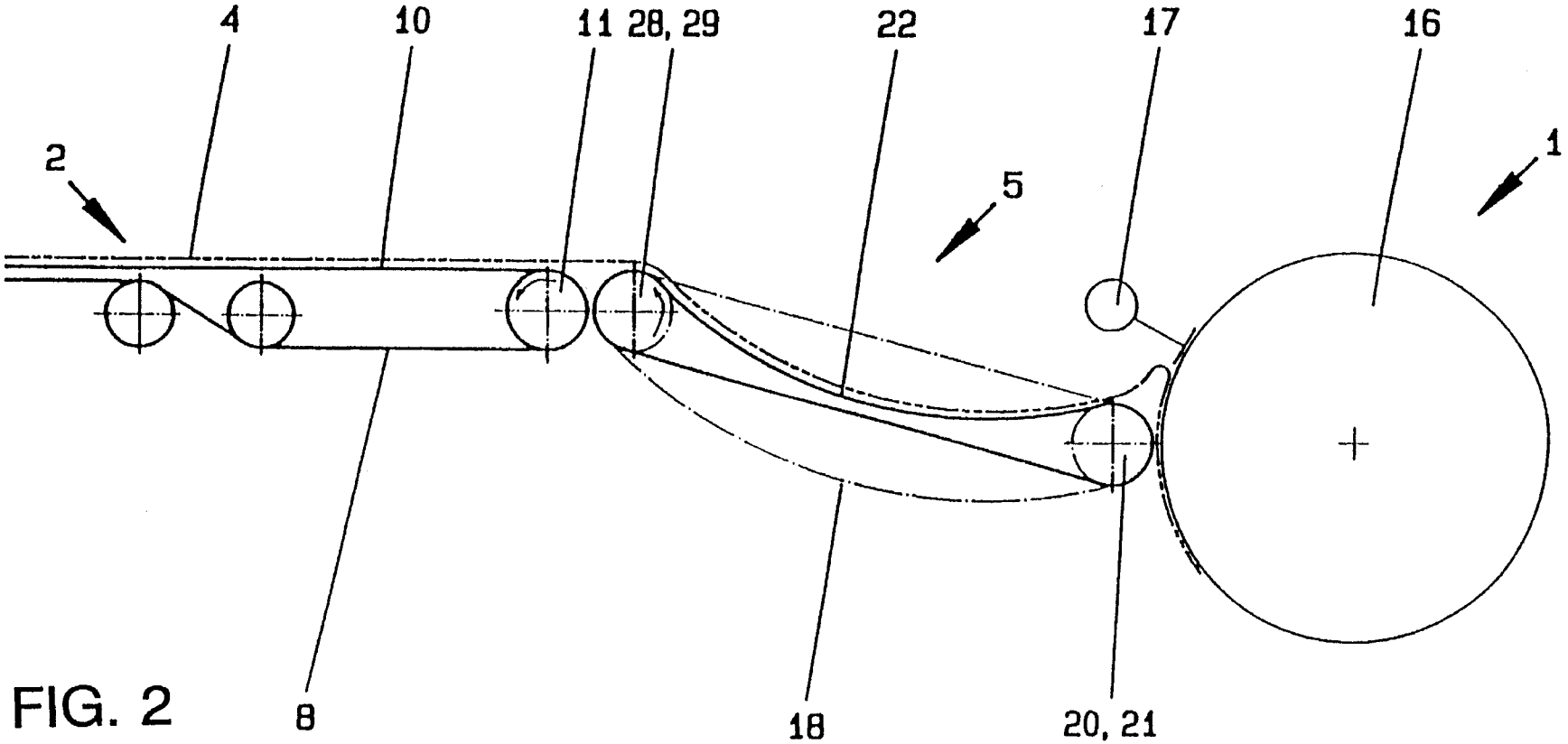
FIGS. 2 and 3 show alternative designs of the web storage means.

FIGS. 1 and 2 show a movable web storage means 5, which is equipped with a driven 29 storage belt 18, which forms a belt loop 22 having variable size. The web 4 is taken up in the belt loop 22. The storage volume is smaller or larger depending on the size of the loop. The movable web storage means 5 with the storage belt 18 of FIGS. 1 and 2 are suitable for delicate webs 4, which are supported and guided by means of the storage belt 18.

A simple storage belt 18, which is designed as a revolving, driven continuous loop, is used in the exemplary embodiment of FIG. 2. It has an excessive length, such that a lower end and/or an upper end can produce a slack. The size of the belt loop 22 formed by the upper end changes accordingly. In FIG. 2, the web 4 lies open in the belt loop 22. The slack is essentially determined by the belt drive and the weight of both the storage belt 18 and the web 4.

A tensioning device, which holds the storage belt 18 under tension, is arranged on the belt loop 22 in FIG. 1. The tensioning device has a storage carriage 23 that extends within the belt loop 22, which preferably hangs in the vertical direction, and can be moved back and forth in the direction of the loop. The storage carriage 23 moves by its own weight or by a suitable drive and holds the belt loop 22 under tension. Under the belt loop 22 is located a movable tensioning carriage 24 with deflecting rollers, over which the storage belt 18 runs. The tensioning carriage 24 moves in the opposite direction of the storage carriage 23. The tensioning carriage holds the storage belt 18 under tension by its own weight or a suitable controlled drive 36 and provides for a compensation in the belt length.

The storage carriage 23 has a continuously revolving support belt 25, which is guided via two deflecting rollers 26 at the ends of the storage carriage 23. By means of this, the web 4 is guided and protected between two belts 18, 25 at least in the movable belt loop 22. The support belt 25 may be freely movable and is then moved along by friction contact with the moving web 4 by friction contact. As an alternative, a controlled belt drive 35 may also be present, which drives the tensioning belt 25, taking the traveling movements of the storage carriage 23 into consideration, in such a manner that the belts 18, 25 move essentially at identical speed in the area of the belt loop 22.

Figure 3:
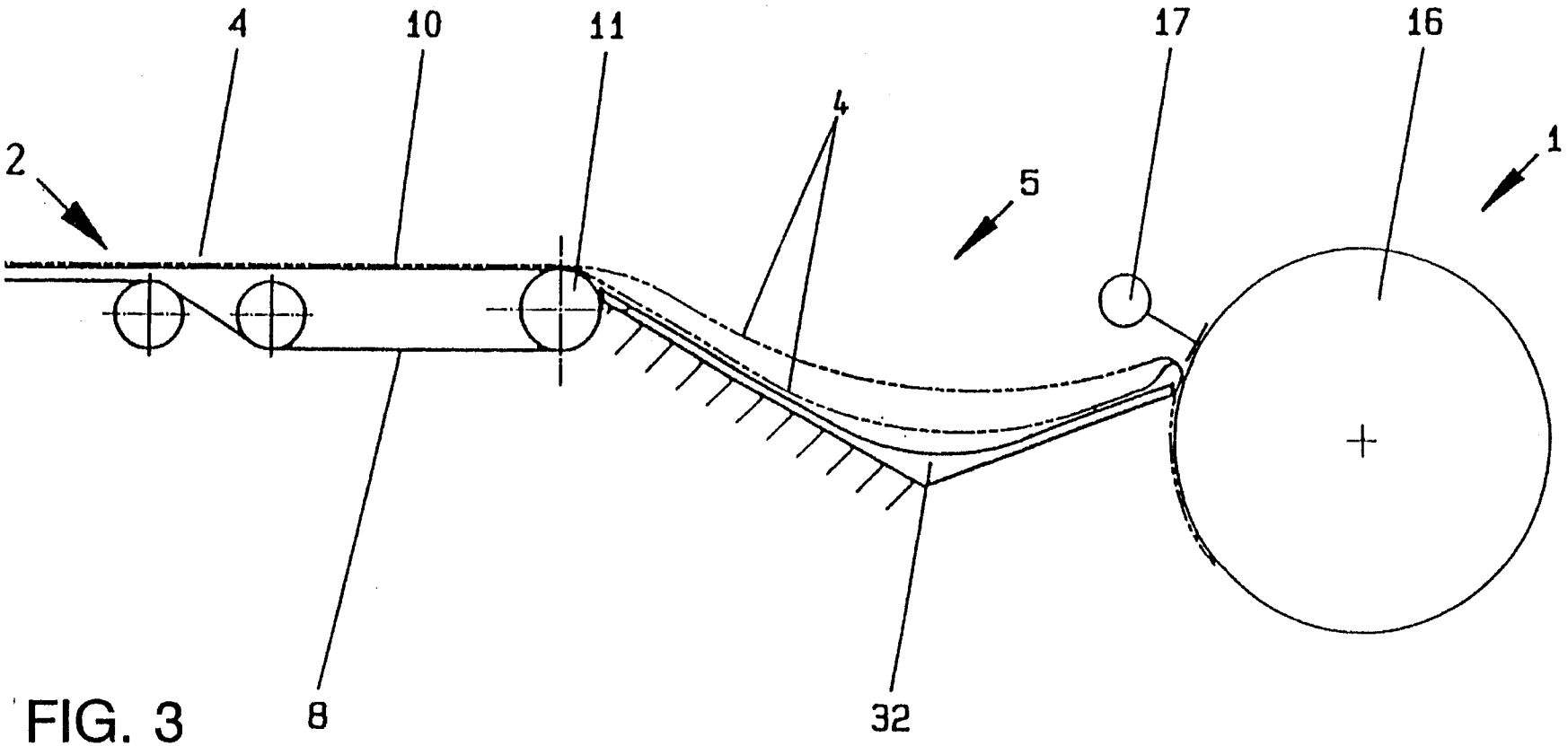

In contrast, FIG. 3 shows a simple variant, in which the web storage means 5 consist of a concave trough 32, e.g., a sheet steel trough. This embodiment is more suitable for relatively stable webs 4, since these webs hover above the trough 32 at least occasionally with a more or less large slack and thus are not constantly supported.

The web storage means 5 act as a buffer and make it possible to feed occasionally more or less web 4 to the nonwoven fabric layering apparatus 2 in a controlled manner. This possibility is used to prevent edge buildups in the nonwoven fabric 31 in the exemplary embodiment shown.

For this purpose, the rotational speed VB of the layering belts 8, 9 at the inlet 10 can also be changed in a preferred embodiment. The rotational speed then fluctuates at least in the inlet area 10 in rhythm with the absolute layering carriage speed VL. FIGS. 5 and 6 illustrate this effect on the speed.

Figure 5A:
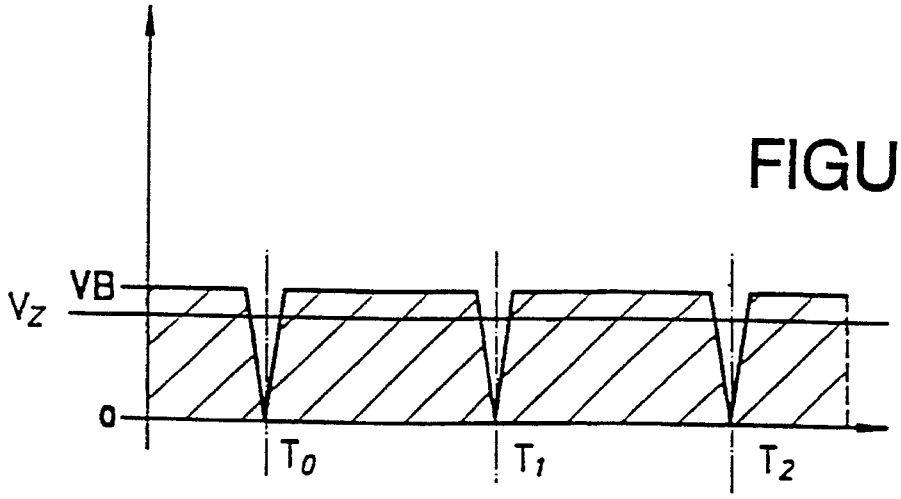
Figure 5B:
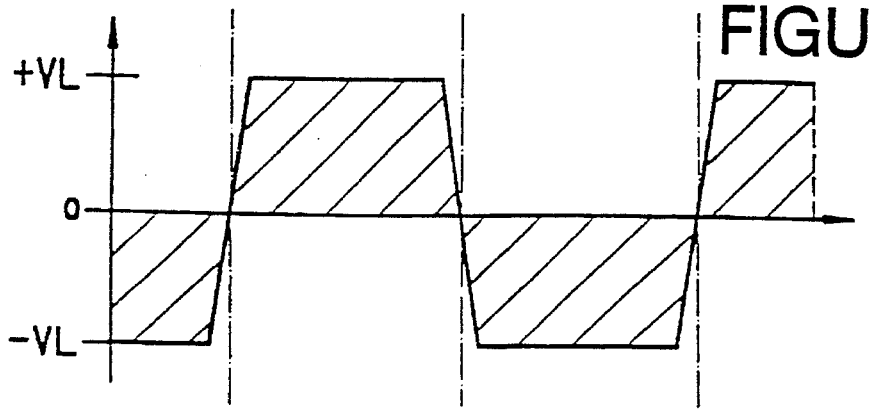
Figure 5C:
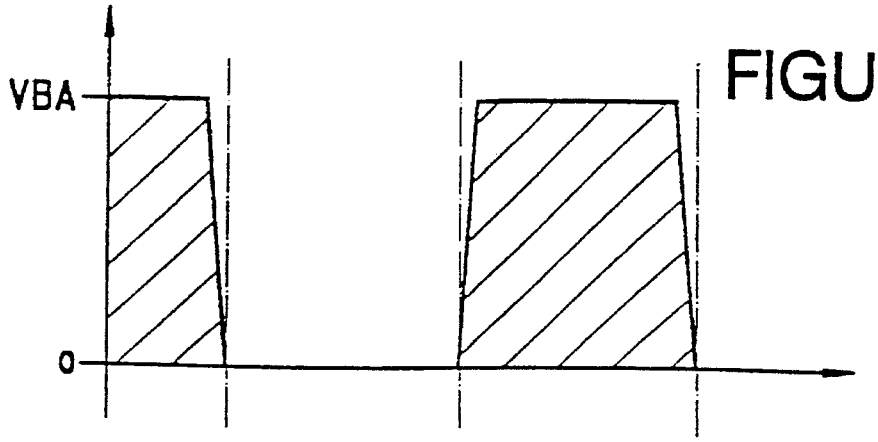
Figure 6A:
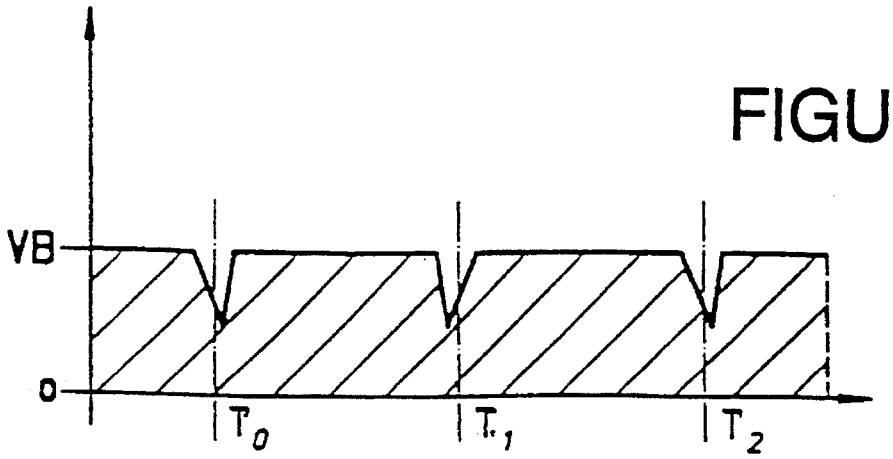
Figure 6B:
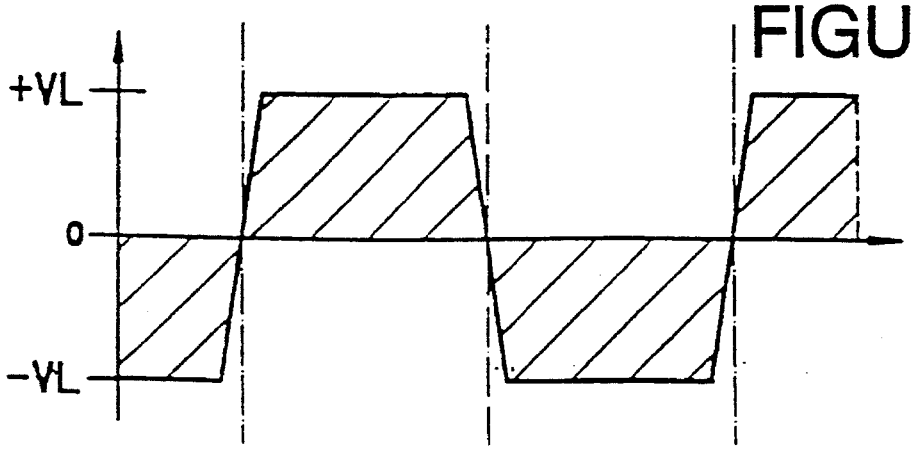
Figure 6C:
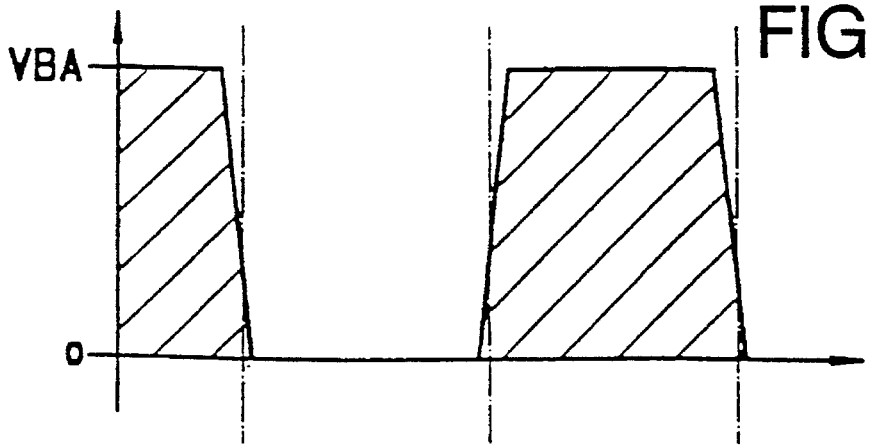
Figure 7:
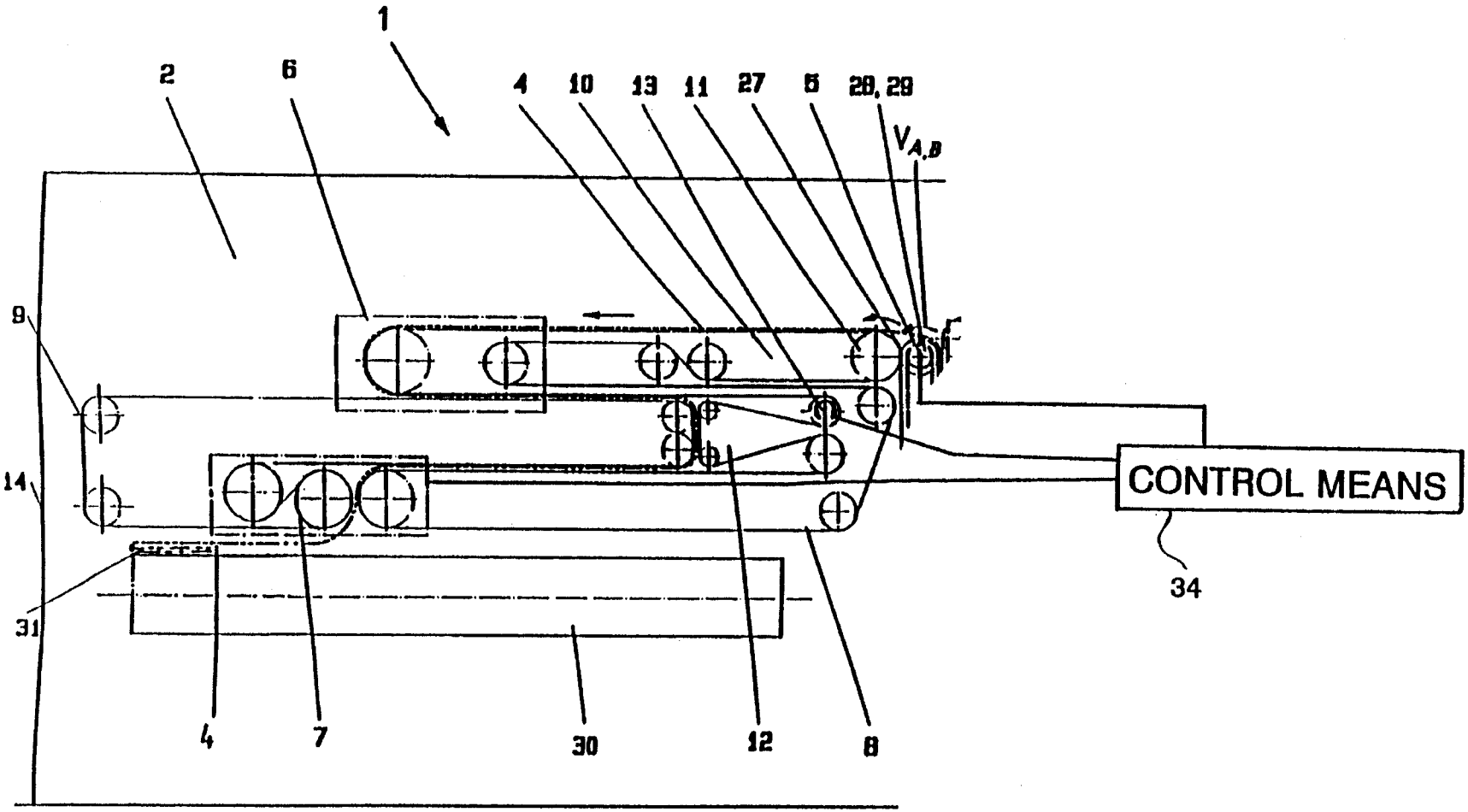
FIG. 7 shows the control means interacting with the layering apparatus and the storage means.

According to FIGS. 5A and 6A, even the rotational speed VB of the layering belts 8, 9 decreases at the reversal points of the layering carriage 7. This results in less web 4 coming out of the layering carriage 7 at the reversal points. This web is temporarily stored in the web storage means 5. Over the further path of travel of the layering carriage 7, the web storage means 5 is then emptied again, whereby the web 4 is correspondingly quickly drawn off.

As FIG. 5A shows, the level of the rotational speed VB in the peak area is greater than the steady speed VZ with which the web 4 comes from the web producer 3 and enters into the web storage means 5. However, the area integral above the speed curve of VB is equal to the area integral above the web feeding speed VZ within the periods T0 to T1 and T1 to T2, as well as the following periods.

The fluctuation of the rotational speed VB of the layering belts 8, 9 at the inlet in rhythm with the layering carriage speed VL means that the speeds behave in a qualitatively similar manner. The rotational speed VB must, however, not drop to zero at the reversal points. After the web 4 at the outlet of the layering carriage 7 swings out with a loop in a manner associated with inertia in the reversal points, it is recommended to lower the rotational speed VB only to a mean value, for example, approximately half of the standard speed level. This results in an optimized web layering in the edge areas.

The minimum values of the rotational speed VB must also not coincide with the stopping of the layering carriage 7 and the zero crossing of the layering carriage speed VL. As FIG. 6A illustrates in the preferred embodiment, these minimum values may be staggered with regard to time. In the exemplary embodiment shown, such a speed graph arises, if the layering belt drive 13 travels a flank that is straight, for the most part, at the speed VBA at the reversal areas while slowing down. In this case, the speed VBA reaches its zero level while slowing down later than the layering carriage speed VL. At the next reversal point, the speed VBA again starts correspondingly sooner than the layering carriage speed VL.

As the graphs still further illustrate, in the case of the forward path with positive layering carriage speed VL, i.e., if the layering carriage 7 moves to the right in FIG. 1, the speed VBA of the layering belt drive 13, apart from the reversal areas, equals zero. The rotational speed VB of the layering belts 8, 9 at the inlet 10 is then equal to the layering carriage speed VL in the area between the reversal points. VL is, however, as mentioned above, higher than the feeding speed VZ of the web 4 from the web producer 3.

On the return path of the layering carriage 7, i.e., if this layering carriage moves to the left in the embodiment of FIG. 1 and if the layering carriage speed VL has a negative sign, the speed VBA of the layering belt drive 13 again increases suddenly. Even in this second period between T1 and T2, the rotational speed VB and the layering carriage speed VL are, with the sign corrected, identical in the area between the reversal points. The speed VBA of the layering belt drive 13 is then twice as high as the absolute values of VB and VL. The speed ratios mentioned apply to both graphs of FIGS. 5 and 6.

The movable web storage means 5 of FIGS. 1 and 2 are controlled in accordance with the rotational speed VB of the layering belts 8, 9. The size of the belt loop 22, including the storage volume, is hereby changed in a manner designed to meet requirements. A storage belt drive 29 for the storage belt 18 is provided in the output area 27, where the web leaves the web storage means 5 and reaches the inlet 10 of the nonwoven fabric layering apparatus 2. This drive is, for example, directly coupled with the inlet rollers 11 via a chain or the like. By means of this, the output speed VA of the web storage means 5 is essentially equal to the rotational speed VB of the layering belt 8 in the inlet 10. To maintain a certain feed tension, VB can be somewhat greater than VA. By means of coupling the speeds VB and VA, the storage volume also fluctuates in rhythm with the movements of travel. Instead of a direct coupling of the rollers 11, 28, an independent drive 29, which is controlled in accordance with the rotational speed VB, may be provided. The drive 29 may also suitably be derived from the layering belt drive 13.

In the feed area 19, the web 4 preferably arrives at the storage belt 18 from the doffing cylinder 16 at an essentially constant feed speed VZ. At the beginning of the feed area 19, the storage belt 18 is guided via a deflecting roller 20. The deflecting roller 20 may be provided with its own drive 21 or may be coupled directly with the doffing cylinder 16. As an alternative, the deflecting roller 33, which is arranged on the upper end of the feed area 19 in FIG. 1, may also be driven. The storage belt 18 is driven at the speed VZ in the feed area 19 in the cases mentioned.

The slack of the belt loop 22 changes depending on how the layering speed VA and the feed speed VZ react to one another. This is shown by continuous and dotted lines in FIG. 2. At the moment when the rotational speed VB of the layering belts 8, 9 drops below the feed speed VZ, the slack of the belt loop 22 increases. This is preferably the case at the reversal points of the layering carriage 7. In the exemplary embodiment of FIG. 2, the upper end of the storage belt 18 sags accordingly. In the exemplary embodiment of FIG. 1, the belt loop 22 is longer towards the bottom.

In the central area of travel of the layering carriage 7 between the phases of accelerating and slowing down, the output speed VA or the rotational speed VB is again greater than the feed speed VZ, by means of which the upper end of the storage belt 18 is tensioned and the web storage means 5 is again emptied.

In a variation of the above-described exemplary embodiment, the length of the belt loop 22 in FIG. 1 may be actively determined by means of the lifting and lowering movements of the storage carriage 23. In this case, the drive 29 provided on the deflecting roller 28 can be omitted. Instead, the storage carrier 23 proceeds via a suitable lifting drive, which is controlled by and possibly derived from the rotational speed VB of the layering belts 8, 9. In another variation of the exemplary embodiments of the web storage means 5 described, the web 4 that is fed may also be covered in a suitable manner outside the belt loop 22. In FIG. 1, a revolving cover belt could be provided, e.g., above the feed area 19.

In the above-described preferred embodiment, the web storage means 5 are combined with the rotational speed VB of the layering belts 8, 9, which fluctuates in rhythm with the layering carriage speed VL. In this case, the web storage means 5 is emptied or filled corresponding to the rotational speed VB of the layering belts 8, 9. Proceeding in this manner has the advantage that no negative slack is produced in the web.

As an alternative, the edge thickenings even with negative slack in the web 4 are eliminated. A prior-art nonwoven fabric layering apparatus 2 with kinematics according to the state of the art, as is shown in FIG. 4, may be used for this purpose. The rotational speed VB of the layering belts 8, 9 is then constant. By means of the controlled emptying and filling of the web storage means 5, which can be performed by control means 34, extensions or thinning of the web may occasionally be generated at the inlet 10. If this happens with the correct forward movement with regard to time, these extensions then precisely reach the discharge of the layering carriage 7, when the carriage is located at the reversal points of its path. In the case of discharge or immediately after the layering, the extensions shrink and thereby reduce the edge buildups. The extensions are obtained by an occasional expansion of the web storage means 5. Subsequently, the web storage means is again continuously emptied, i.e., the web 4 is somewhat compressed or thickened.

The web storage means 5 can be used not only for compensating the edge thickness of the nonwoven fabric 31, but also for so-called profiling, i.e., a variation in thickness of the non-woven fabric 31 in the standard layering area. The thickness of the nonwoven fabric changes if the web 4 comes out at another speed on the layering carriage 7 when the layering carriage travels back and forth. For this purpose, a difference in speed between the traveling speed VL of the layering carriage 7 and the rotational speed VB of the layering belts 8, 9 is produced by control means 34. In addition, the rotational speed VB of the layering belts 8, 9 compared with the layering carriage speed VL in the layering area between the reversal points is preferably changed. The profiling can be combined with the above-described edge thickness compensation or can even take place independently.

Advantageously, even during the profiling, the output speed VA of the web storage means 5 is coupled with the rotational speed VB of the layering belts 8, 9. By means of this, a negative slack of the web 4 in the nonwoven fabric layering apparatus 2 can be avoided.

If the rotational speed VB of the layering belts 8, 9 is higher than the traveling speed VL of the layering carriage 7, more web 4 comes out at the discharge, which leads to a selective thickening of the layered nonwoven fabric 31. Conversely, if VB is lower than VL, less web 4 is layered, and thus, a selective thinning of the nonwoven fabric 31 is produced. In the weight assessment, the thinnings and thickenings are compensated, such that, overall, just as much web 4 is layered over the layering width, as is fed to the nonwoven fabric layering apparatus 2 on the feed side. By means of the upstream web storage means 5, these fluctuations in the doffing of the nonwoven fabric layering apparatus 2 compared with the preferably constantly feeding carding machine 3 can be compensated.

In a variation of the above-described technique used in the profiling, the nonwoven fabric layering apparatus 2 can also run with constant kinematics according to the state of the art in accordance with FIG. 4. By means of controlled emptying or filling, preferably by the control means 34 controlling drive 29 the independently driven web storage means 5 then produces thinnings or thickenings in the web 4, which then move through the nonwoven fabric layering apparatus 2 and come out and are layered at the desired sites of the layering width on the layering carriage 7 by observing a suitable forward movement with regard to time.

In another variant, the layering carriage speed VL compared with the rotational speed VB of the layering belts can be changed for the profiling. In this case, the web storage means 5 is controlled by the layering carriage drive or in another suitable manner. In both above-mentioned variants, a combination of the profiling with the initially described edge thickness compensation is possible. Moreover, the embodiments described may be arbitrarily combined.

While specific embodiments of the invention have been shown and described in detail to illustrate the application of the principles of the invention, it will be understood that the invention may be embodied otherwise without departing from such principles.

LIST OF REFERENCE NUMBERS:

| | |
|---|---|
| 1 | Device for producing nonwoven fabric |
| 2 | Nonwoven fabric layering apparatus |
| 3 | Web producer, carding machine |
| 4 | Web |
| 5 | Web storage means, compensator |
| 6 | Upper carriage |
| 7 | Layering carriage |
| 8 | Layering belt |
| 9 | Layering belt |
| 10 | Inlet |
| 11 | Inlet rollers |
| 12 | Belt deflection means |
| 13 | Layering belt drive |
| 14 | Frame |
| 15 | Drum |
| 16 | Doffing cylinder |
| 17 | Doffing comb |
| 18 | Storage belt |
| 19 | Feed area |
| 20 | Deflecting rollers |
| 21 | Drive |
| 22 | Belt loop |
| 23 | Tensioning device, storage carriage |
| 24 | Tensioning carriage |
| 25 | Support belt |
| 26 | Deflecting roller |
| 27 | Output area |
| 28 | Output roller |
| 29 | Drive |
| 30 | Discharging belt |
| 31 | Nonwoven fabric |
| 32 | Trough |
| 33 | Deflecting roller |
| VA | Output speed (web storage means) |
| VB | Rotational speed (layering belt) |
| VAB | Speed of the layering belt drive |
| VL | Layering carriage speed |
| VZ | Feeding speed (web producer) |

We claim:

1. A device for producing nonwoven fabric, the device comprising:

a web producing means for generating a nonwoven web from fiber;

a nonwoven fabric layering means for receiving the web from said web producing means and for layering the web, said nonwoven fabric layering means including a takeup carriage and a reciprocating layering carriage, said layering carriage moving in a reciprocating pattern;

web storage means positioned between said web producing means and said nonwoven fabric layering means, said web storage means storing a variable volume of the web.

2. A device in accordance with claim 14, wherein:

said web storage means stores said variable volume dependent on a speed VB of the web at an inlet of said nonwoven fabric layering means.

3. A device in accordance with claim 2, wherein:

said nonwoven fabric layering means varies said speed VB dependent on an absolute speed of said layering carriage.

4. A device in accordance with claim 1, wherein:

said web storage means stores said variable volume dependent on travel movements of said layering carriage.

5. A device in accordance with claim 1, wherein:

said web storage means includes a storage belt for receiving the web, said storage belt forming a storage loop of variable size.

6. A device in accordance with claim 5, wherein:

said web storage means also includes a tensioning means for tensioning said storage belt.

7. A device in accordance with claim 6, wherein:

said tensioning means includes a storage carriage with a support belt revolving around rollers.

8. A device in accordance with claim 7, wherein:

said tensioning means includes a tensioning carriage positioned outside said storage loop and movable opposite to movements of said storage carriage.

9. A device in accordance with claim 8, wherein:

one of said storage carriage, said support belt and said tensioning carriage includes a controlled drive.

10. A device in accordance with claim 5, wherein:

said storage belt includes a storage belt drive for driving said storage belt at a position adjacent said web producing means and at a speed substantially equal to an exit speed of the web from said web producing means.

11. A device in accordance with claim 5, wherein:

said storage belt includes a storage belt drive for driving said storage belt at a position adjacent said nonwoven fabric layering means and at a speed substantially equal to a speed VB of the web at an inlet of said nonwoven fabric layering means.

12. A device in accordance with claim 5, wherein:

said storage belt has an output roller coupled with an input roller of said nonwoven fabric layering means.

13. A device in accordance with claim 1 wherein:

said nonwoven fabric layering means includes a layering belt with a belt deflection means, a layering belt drive for said layering belt being mounted on said belt deflection means.

14. A device for producing nonwoven fabric, the device comprising:

a web producing means for generating a nonwoven web from fiber material at a first rate;

a nonwoven fabric layering means for receiving the web from said web producing means and layering the web in a reciprocating pattern at a variable rate with respect to said first rate of said web producing means, said nonwoven fabric layering means including layering belts, a takeup carriage and a layering carriage, said layering carriage moving in said reciprocating pattern and changing speed during moving in said reciprocating pattern, said takeup carriage means compensating said layering belts for moving of said layering carriage;

web storage means positioned between said web producing means and said nonwoven fabric layering means, said web storage means storing excess portions of the web when said variable rate is less than said first rate and releasing said excess portions of the web when said variable rate is greater than said first rate.

15. A device in accordance with claim 14, wherein:

said nonwoven fabric layering means and said web storage means include means for changing said variable rate of layering the web.

16. A device for producing nonwoven fabric, the device comprising:

a web producing means for generating a nonwoven web from fiber material at a first rate;

a nonwoven fabric layering means for receiving the web from said web producing means and discharging the web in a reciprocating pattern, said nonwoven fabric layering means including a layering carriage, said layering carriage uniformly moving in said reciprocating pattern;

web storage means positioned between said web producing means and said nonwoven fabric layering means, said web storage means buffering differences in a rate of the web generated by said web producing means and received by said layering means;

control means for varying an amount of the web discharged by said layering means dependent on a position of layering carriage in said reciprocating pattern.

17. A device in accordance with claims 16, wherein:

said control means also varies discharge of the web dependent on a speed of said layering carriage.

18. A device in accordance with claim 16, wherein:

said control means varies discharge of the web by varying a speed of the web in said layering means.

19. A device in accordance with claim 16, wherein:

said layering means includes first and second layering belts, said layering belts interacting with said layering carriage, said layering means including a drive means for moving said layering belts;

said control means coordinating said drive means with said movements of said layering carriage to vary discharge of the web.

20. A device in accordance with claim 16, wherein:

said control means varies a volume of the web delivered from said storage means to said layering means to vary discharge of the web from said layering means.

21. A device in accordance with claim 20, wherein:

said control means varies the volume of the web by delivering the web from said storage means at a speed different than said layering means receives the web.

* * * * *